US010648191B1

(12) United States Patent
Oliphant et al.

(10) Patent No.: US 10,648,191 B1
(45) Date of Patent: May 12, 2020

(54) POLE STABILIZING DEVICE

(71) Applicant: EXO Group LLC, Magnolia, TX (US)

(72) Inventors: Wesley J Oliphant, Tomball, TX (US); Zachary J Oliphant, The Woodlands, TX (US); Garett W Oliphant, Pinehurst, TX (US)

(73) Assignee: EXO Group LLC, Magnolia, TX (US)

( * ) Notice: Subject to any disclaimer, the term of this patent is extended or adjusted under 35 U.S.C. 154(b) by 0 days.

(21) Appl. No.: 16/428,971

(22) Filed: Jun. 1, 2019

(51) Int. Cl.
*E04H 12/22* (2006.01)
*E02D 27/42* (2006.01)

(52) U.S. Cl.
CPC ..... *E04H 12/2261* (2013.01); *E04H 12/2292* (2013.01); *E02D 27/42* (2013.01)

(58) Field of Classification Search
CPC ..... E04H 12/2261; E04H 12/2292; E04H 12/2253; E04H 12/2276; E02D 27/42
USPC ..... 52/292, 296, 165, 294, 298
See application file for complete search history.

(56) References Cited

U.S. PATENT DOCUMENTS 1,463,715 A * 7/1923 Muhlow ..... E04H 12/2276 52/297
1,730,754 A * 10/1929 Bensley ..... E04H 12/2276 52/296
2,753,962 A * 7/1956 McBerty ..... E04B 2/68 52/93.1
3,193,252 A * 7/1965 Barrett ..... E04G 7/04 254/218
3,213,580 A * 10/1965 Mark ..... E04B 2/825 52/292
4,218,858 A * 8/1980 Legler ..... E02D 5/805 52/165
4,939,037 A * 7/1990 Freeman ..... B29D 23/00 138/130
5,060,435 A * 10/1991 Bogdanow ..... E04H 12/2261 52/165
5,133,164 A * 7/1992 Legler ..... E04H 12/2261 52/165
5,850,718 A * 12/1998 MacKarvich ..... E02D 27/02 52/292
6,945,735 B1 * 9/2005 Doverspike ..... F16L 1/09 248/207
2006/0053714 A1 * 3/2006 Pryor ..... E02D 27/42 52/292

* cited by examiner

*Primary Examiner* — Brent W Herring

(74) *Attorney, Agent, or Firm* — Theresa Camoriano; Guillermo Camoriano; Duncan Galloway Egan Greenwald PLLC

(57) ABSTRACT

A pole stabilizing device for making a field repair on a pole includes a main vertical plate and left and right vertical brackets which are secured to each other to clamp against the pole and which are secured to the foundation of the pole.

5 Claims, 10 Drawing Sheets

POLE STABILIZING DEVICE

BACKGROUND

The present invention relates to a device for stabilizing a pole such as a lighting pole. More particularly, it relates to a device for stabilizing a variety of shapes of poles, including round, tapered, or multisided poles wherein the main shaft has been damaged by corrosion or by fatigue weld cracking, or wherein the anchor bolts securing the pole to the base have been damaged by corrosion or bending.

It is not uncommon that approximately 1 lighting pole of every 10 professionally inspected in large parking lots (such as those found in big box stores) will show signs of distress, primarily due to corrosion or fatigue weld cracking at the bottom few inches of the pole itself or corrosion of the anchor rods, which could lead to the pole falling down. There is a need for an economical, expedient, and effective device for temporarily stabilizing these damaged poles until they can be replaced in a programmed manner.

SUMMARY

The present invention provides a device for field stabilizing a damaged pole by providing a universal pole stabilizing bracket to reinforce the pole at the base until a more permanent pole replacement solution is implemented.

In one embodiment of the present invention, it takes about 30 minutes to install this pole reinforcement device so as to stabilize the pole until the pole can be replaced. The device can be used on poles of many configurations, including square poles, round poles, tapered poles, straight poles, and poles of many diameters. The entire device is reusable, helping to keep the costs down.

Several advantages of this universal pole stabilizing device include:

No service interruption; lighting can remain operational at all times

Fits almost all types of poles (80%-90% of all lighting poles)

Reusable

Addresses issues of both the pole itself and of the anchor rods holding the pole should they also be corroded or otherwise deteriorated Inspectors can carry the universal pole stabilizing devices with them and install them in about 30 minutes when they find a failing pole Can correct corrosion or weld fatigue issues at the base of the pole Can correct issues of bent or corroded anchor bolts

DESCRIPTION

Figure 1:
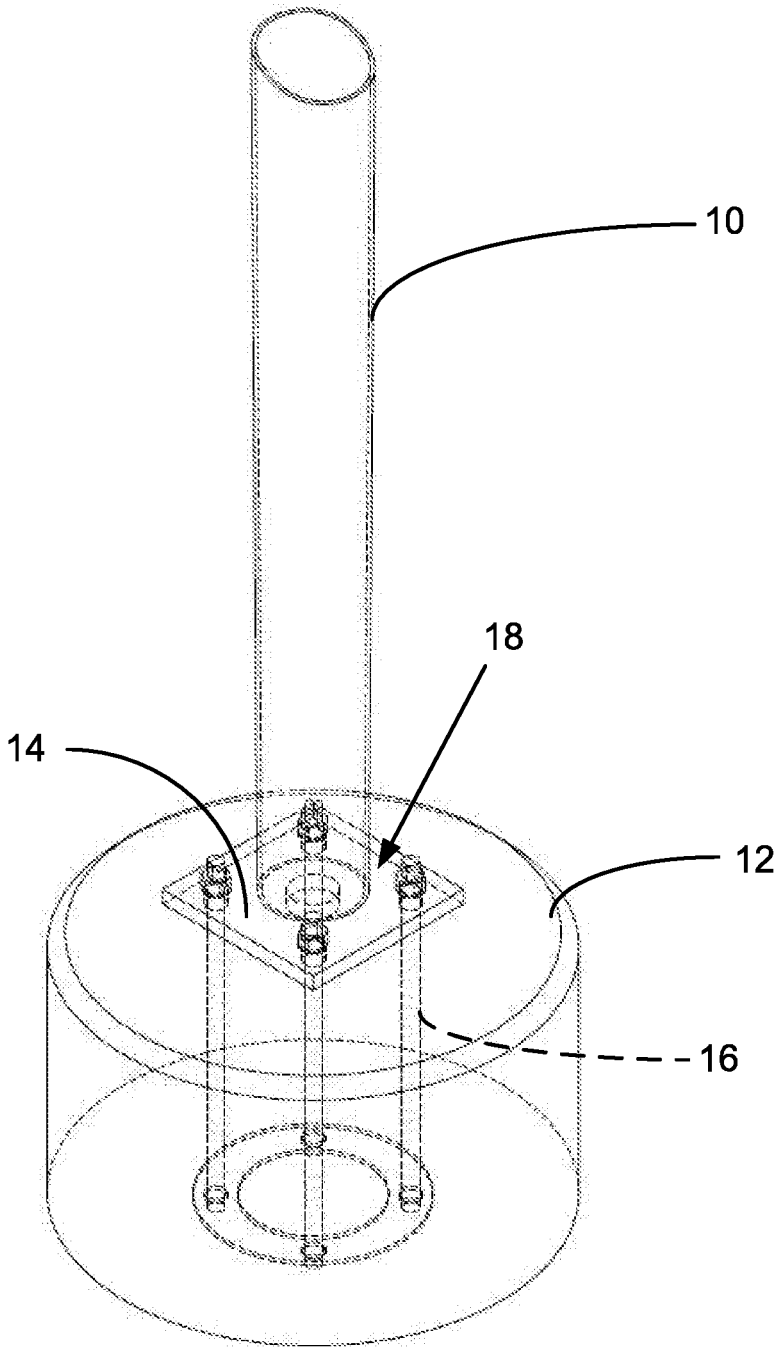
FIG. 1 is a broken-away, perspective side view of a round pole showing the base as well as the anchoring bolts (shown in phantom)

FIG. 1 is a broken-away, perspective view of a round pole 10 secured to a concrete base 12. The pole 10 has a welded-on flange 14, and, as is commonly the case, four anchor rods 16 (shown in phantom) extend through the flange 14 to secure the pole 10 to the base 12. This pole arrangement is commonly used for mounting lights in areas such as large parking lots. As discussed earlier, it is common, upon inspection, to find damage to the pole around the base of the pole (pointed out by the arrow 18) due to corrosion or weld fatigue, and/or damage to the anchor rods 16 securing the flange 14 to the base 12.

FIGS. 2-7 show an embodiment of a pole stabilizing device 20, which can be used to stabilize the damaged pole 10. The pole stabilizing device 20 includes a main vertical plate 22, left and right vertical brackets 24, 26, three "Z" shaped feet 28, a plurality of straps 30, and a plurality of nuts and bolts, all of which are described in more detail below.

Figure 6:
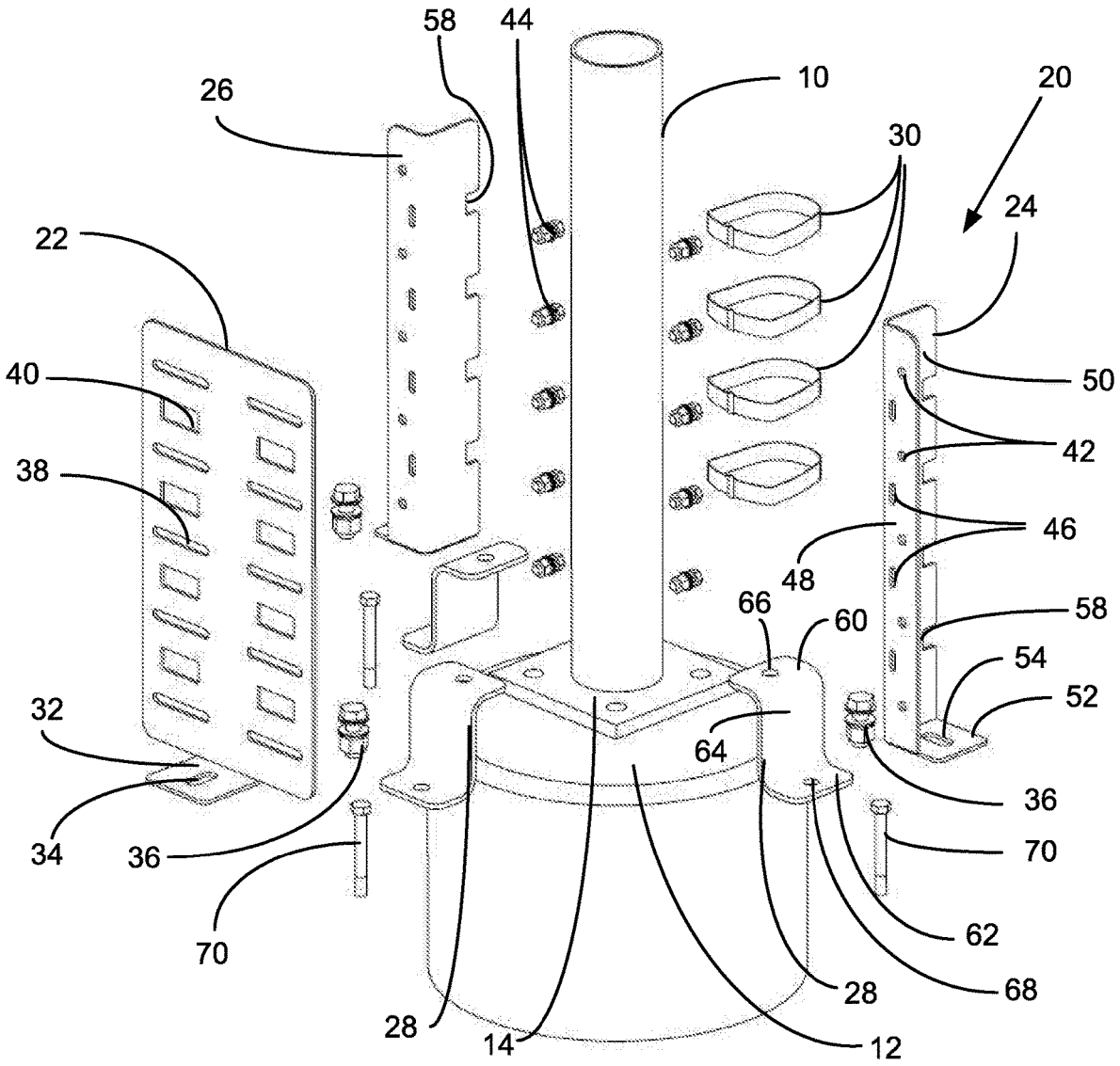
FIG. 6 is an exploded view of the broken-away pole and the stabilizing device of FIG. 2.
Figure 7:
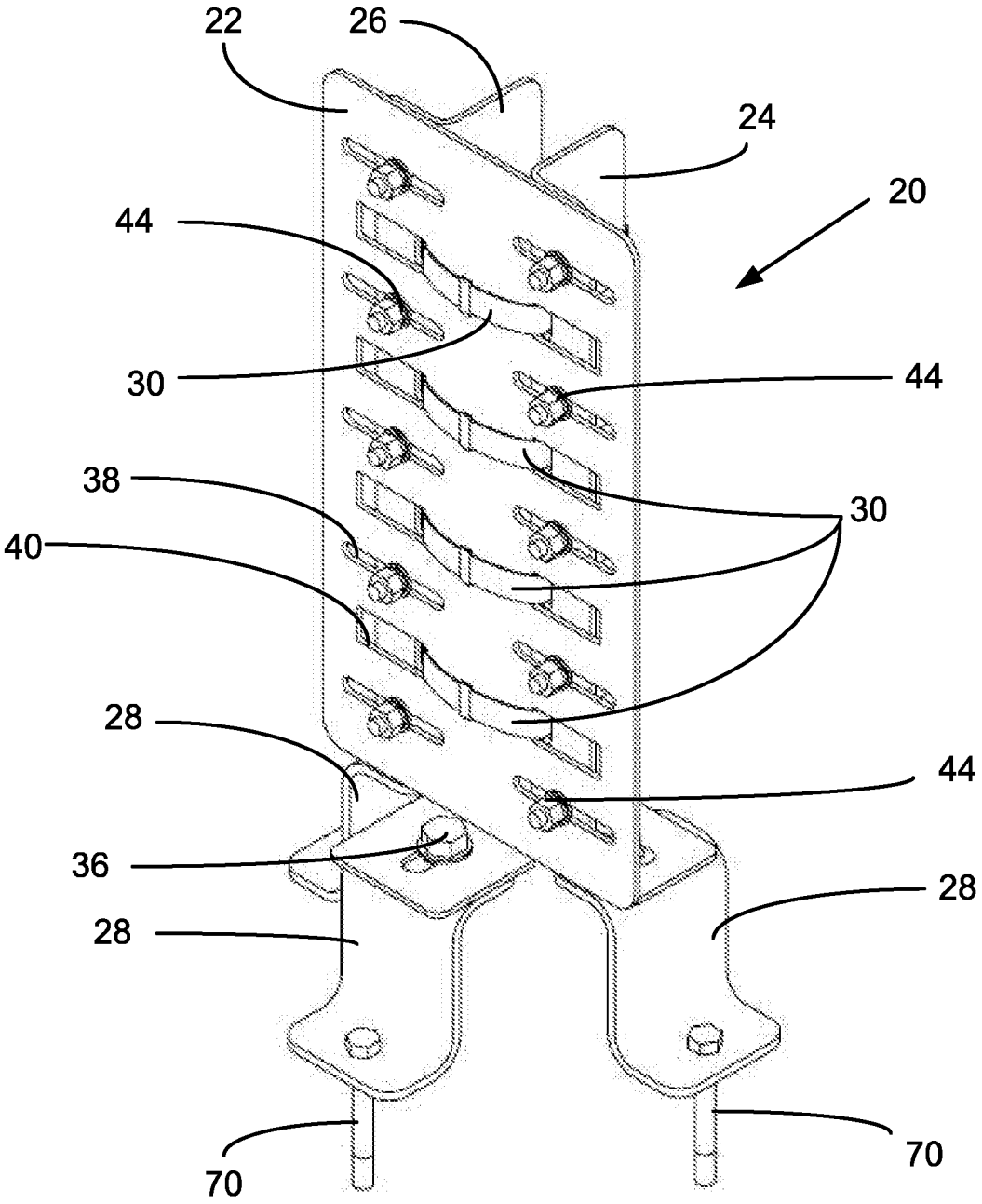
FIG. 7 is an assembled view of the universal pole stabilizing device of FIG. 2 (with the pole and its base omitted for clarity)
Figure 8:
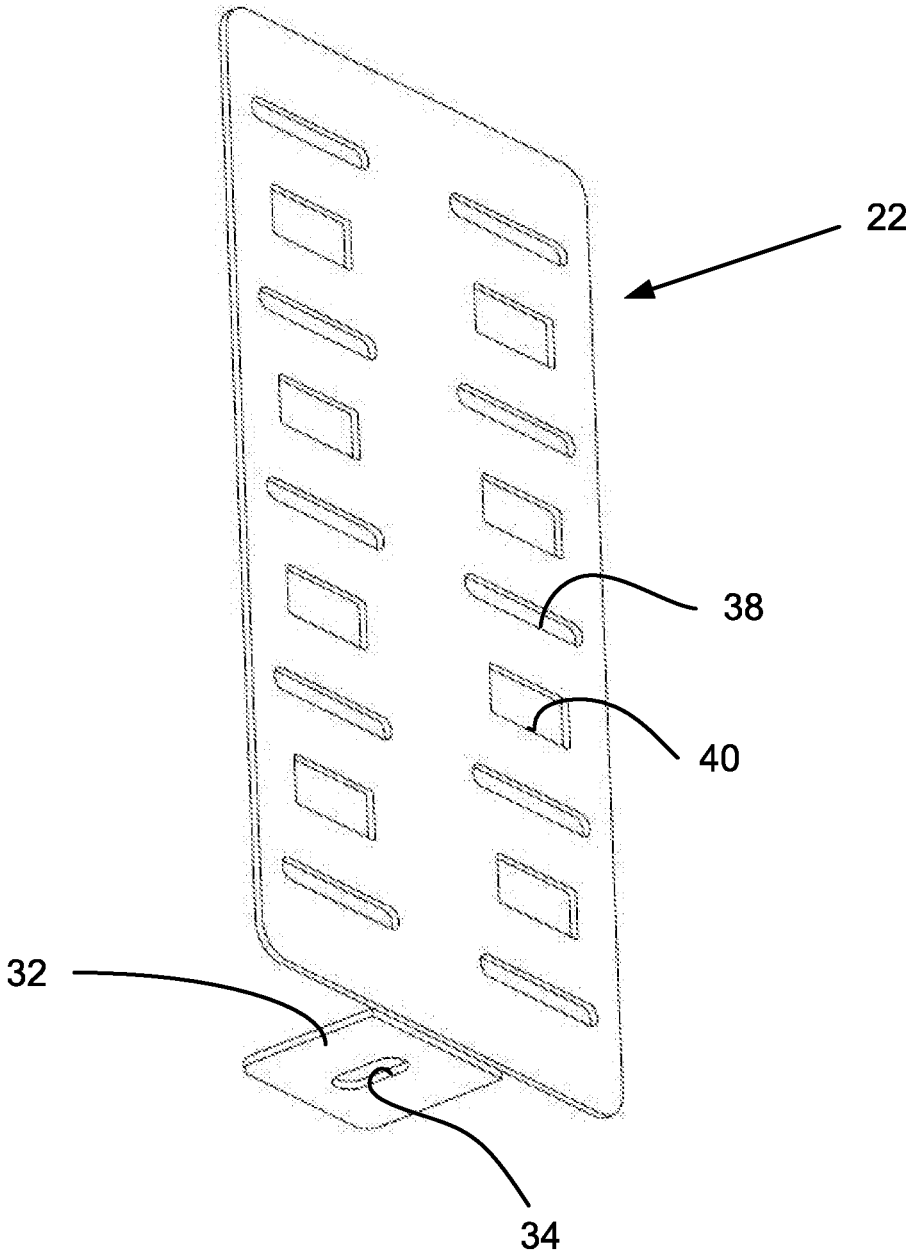
FIG. 8 is a perspective view of the main plate of the universal pole stabilizing device of FIG. 2.

Referring to FIGS. 6-8, the vertical main plate 22 has a horizontal plate bottom foot 32 defining a slotted opening 34 which receives a nut and bolt arrangement 36 for adjustably securing the main plate 22 to one of the three "Z" shaped feet 28, as seen in FIG. 7. The vertical main plate 22 further defines left and right columns of openings, including a plurality of narrow, bolt-receiving slotted openings 38 extending in a horizontal direction and a plurality of taller, strap-receiving slotted openings 40 also extending in a horizontal direction. As best illustrated in FIGS. 6 and 7, each of the narrow, bolt-receiving slotted openings 38 aligns with a corresponding round, bolt-receiving opening 42 in either a left or right vertical bracket 24, 26 to receive a nut and bolt arrangement 44 which adjustably secures the vertical main plate 22 to one of the left and right vertical brackets 24, 26. Also, each of the strap-receiving slotted openings 40 on the left side of the main vertical plate 22 aligns with corresponding vertical, strap-receiving slotted openings 46 in the left and right brackets 24, 26, with corresponding vertical, strap-receiving recesses 58 in the left and right brackets 24, 26, and with a corresponding strap-receiving slotted opening 40 on the right side of the main vertical plate 22 to receive a strap 30 for adjustably securing the vertical main plate 22 to both of the left and right vertical brackets 24, 26 and to the pole 10.

Figure 9:
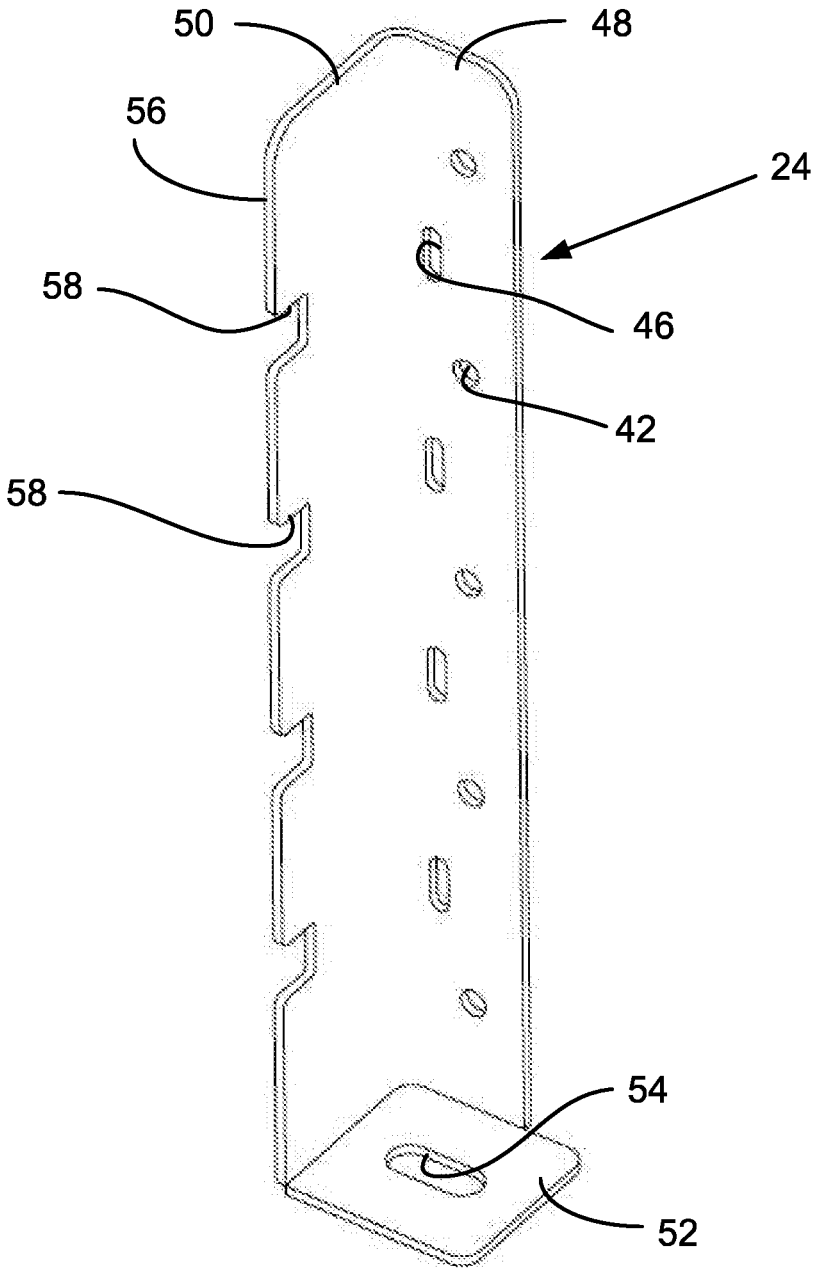
FIG. 9 is perspective view of one of the angled brackets of the universal pole stabilizing device of FIG. 2.

Referring to FIGS. 6, 7, and 9, the left and right brackets 24, 26 are mirror images of each other. Each of the left and right vertical brackets 24, 26 has an "L-shaped" cross-section including a first vertical leg 48 and a second vertical leg 50. Each of the left and right vertical brackets 24, 26 also has a horizontal bracket bottom foot 52. The bracket bottom foot 52 defines a slotted opening 54 which receives a nut and bolt arrangement 36 for adjustably securing the respective vertical bracket 24, 26 to one of the three "Z" shaped feet 28.

The first vertical leg 48 of each vertical bracket 24, 26 defines a plurality of round, bolt-receiving openings 42 and a plurality of vertical, strap-receiving slots 46 as has already been discussed above. The second vertical leg 50 of each vertical bracket 24, 26 has an outer edge 56 defining a plurality of indentations 58, each of which is aligned with a corresponding vertical, strap-receiving slot 46 on the first vertical leg 48 of the respective bracket 24, 26.

The "Z-shaped" feet 28 are all identical to each other and include an inwardly-directed top leg 60, an outwardly-directed bottom leg 62, and a vertically-extending leg 64 which connects the top and bottom legs 60, 62 together. Each of the top legs 60 defines a round opening 66, and each of the bottom legs 62 defines a round opening 68. As discussed earlier, a nut and bolt arrangement 36 is used to adjustably secure the top leg 60 of each "Z-shaped" foot 28 to its respective vertical bracket member—either to the main plate 22 or to the left or right brackets 24, 26 via the opening 66 in the top leg 60 of the respective "Z-shaped" foot 28 which is aligned with its corresponding slotted opening 34 on the main vertical plate bottom foot 32 or with the corresponding slotted opening 54 on the respective bracket bottom foot 52.

Figure 2:
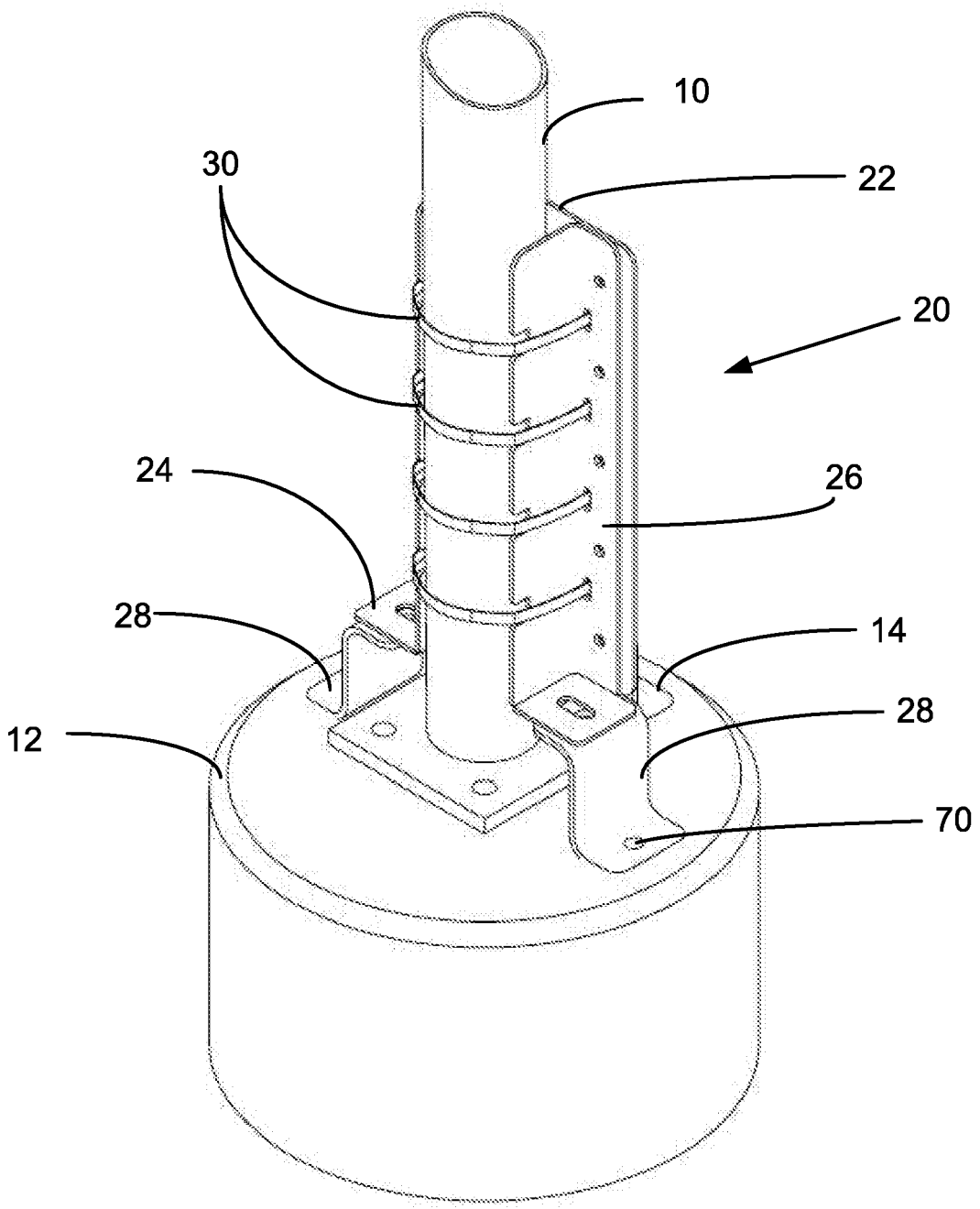
FIG. 2 is a broken-away, perspective view of the pole of FIG. 1 with a universal pole stabilizing device being used to stabilize the pole.
Figure 3:
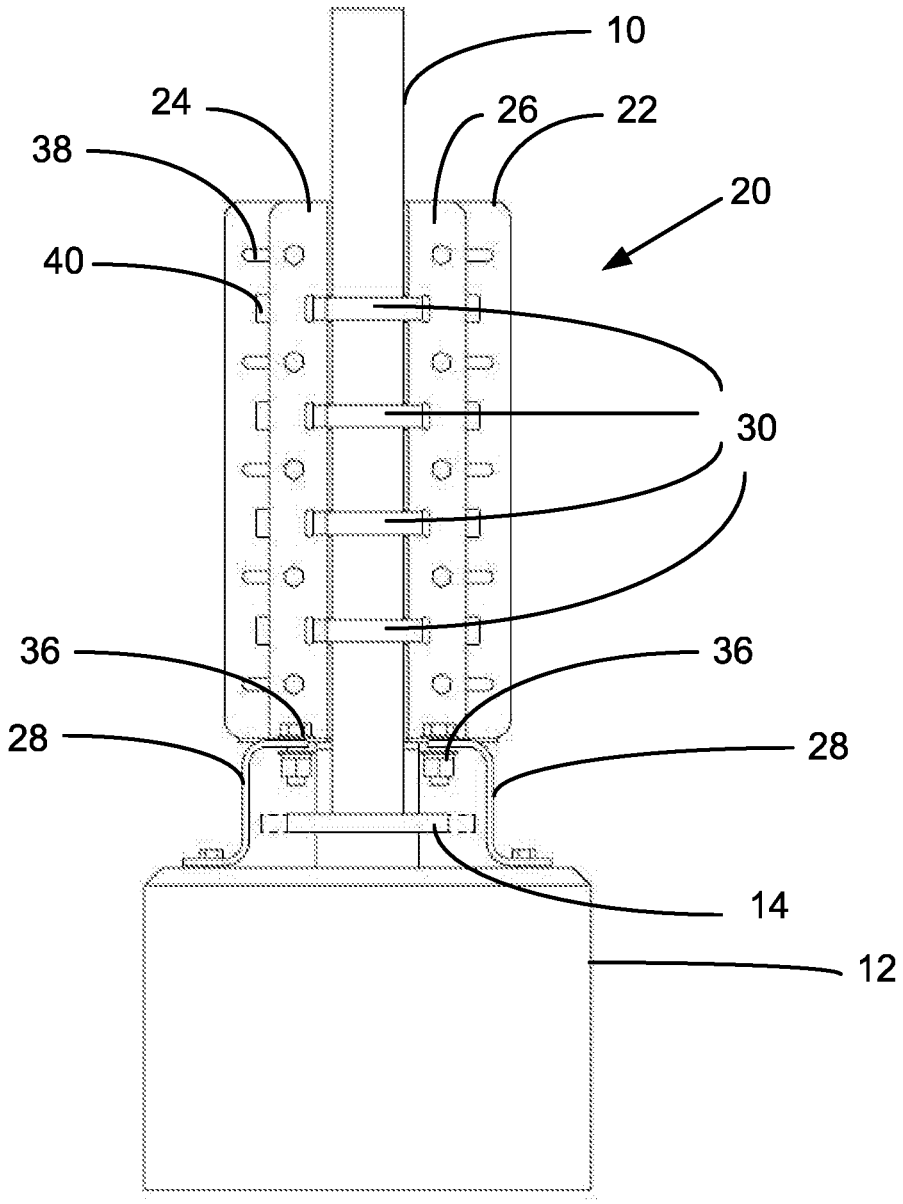
FIG. 3 is a front view of the broken-away pole and the stabilizing device of FIG. 2.
Figure 4:
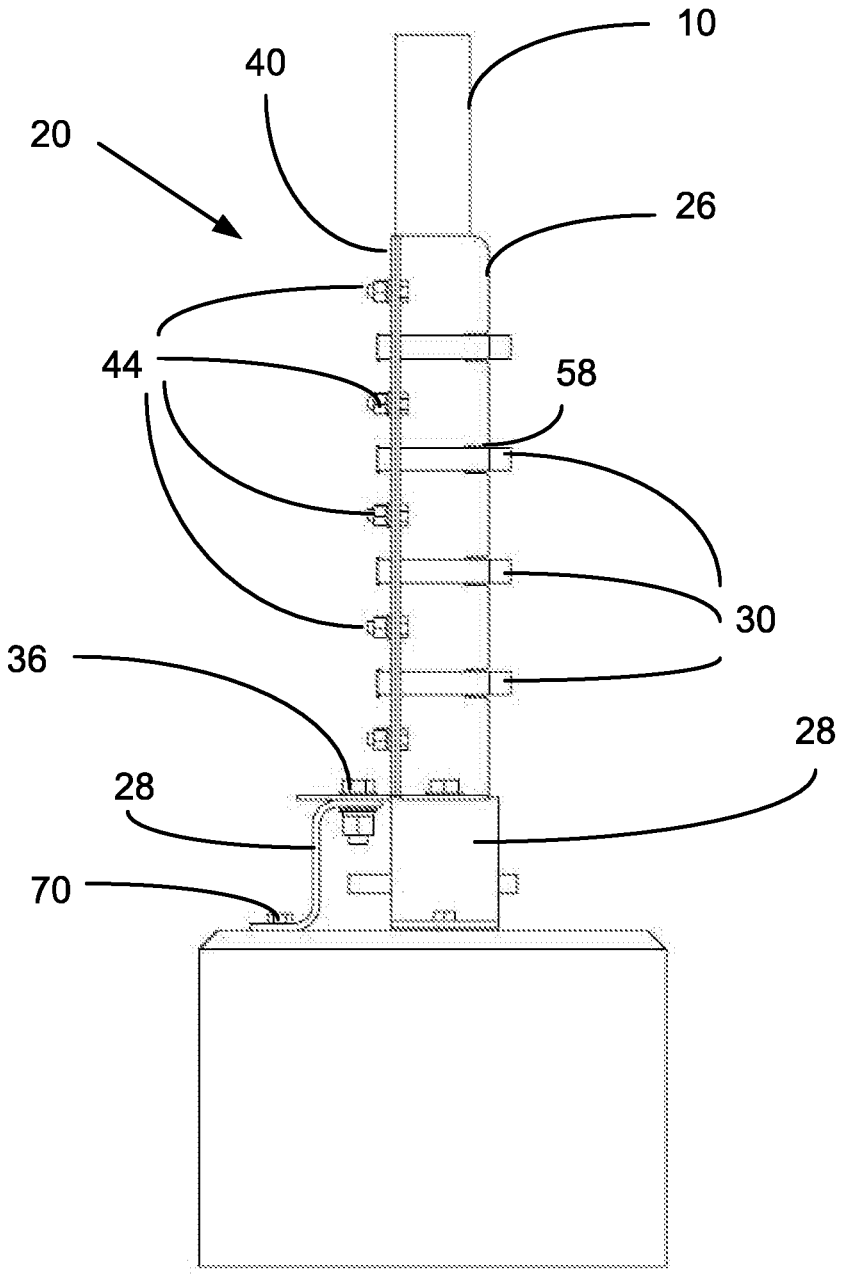
FIG. 4 is a side view of the broken-away pole and the stabilizing device of FIG. 2.
Figure 5:
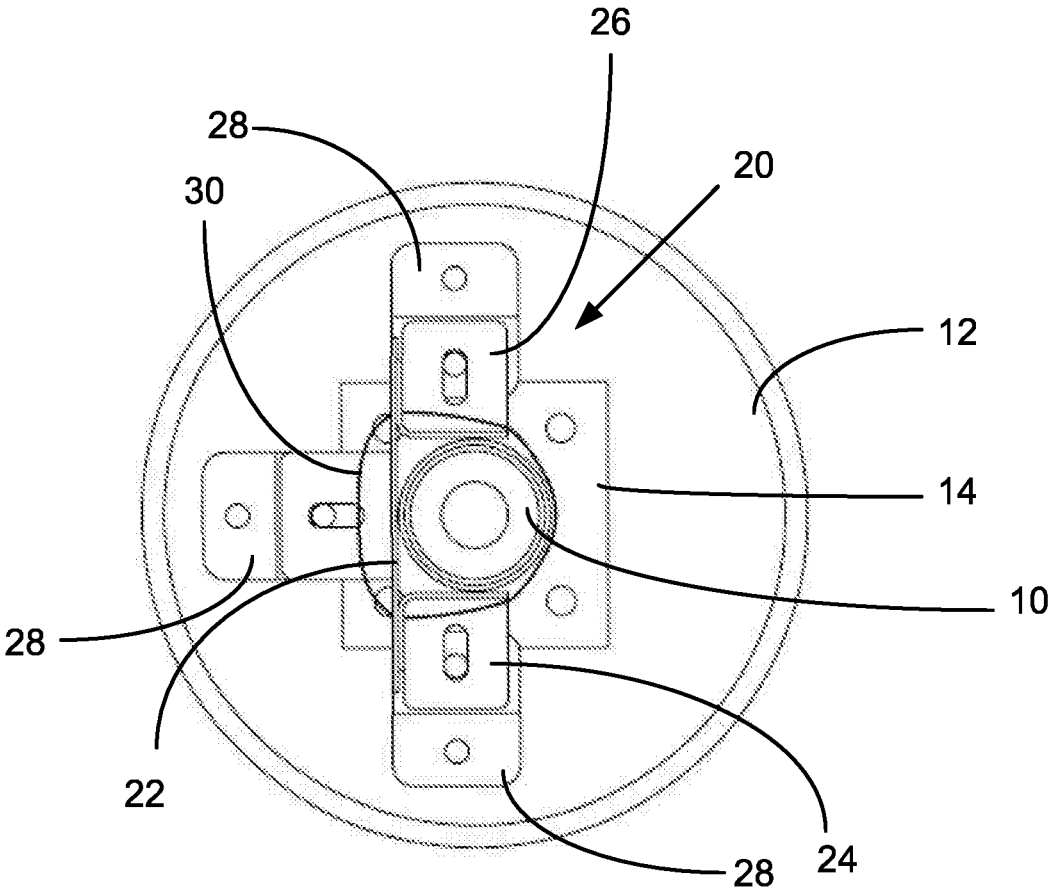
FIG. 5 is a plan view of the pole and the stabilizing device of FIG. 2.

As shown in FIGS. 2 and 6, the bottom leg 62 of each "Z-shaped" foot 28 is secured to the concrete base 12 of the pole 10 using high strength anchor screws 70, such as the Simpson Titen HD® heavy duty anchor screws supplied by Simpson Strong-Tie Co Inc, of Pleasanton, Calif. As best appreciated in FIG. 2, the "Z-shaped" feet 28 allow the pole stabilizing device 20 to be secured to the base 12 at a horizontal distance and a vertical distance removed from the flange 14 of the pole 10. Thus, the areas most susceptible to damage, namely the original anchor rods 16 (See FIG. 1) and the base of the pole 20 adjacent the flange 14 (identified by the arrow 18 of FIG. 1) can be effectively bypassed, allowing the pole stabilizing device 20 to be securely fastened to the base 12 to stabilize the pole 10 despite any potential problem areas at the base of the pole 10 adjacent the flange 14 and/or at the flange area itself and its corresponding anchor rods 16. (If there are no problems with the flange 14 or the anchor rods 16, the "Z-shaped" brackets 28 could be eliminated, and the plate bottom foot 32 and bracket bottom feet 52 could be secured directly to the flange 14.)

Finally, straps 30 are used to releasably and adjustably secure the pole stabilizing device 20 to the pole 10. The straps 30 preferably are stainless steel bands, such as the Bolt-A-Band™ Banding system by Aluma-Form, Inc. of Memphis, Tenn., which are tightened using bolts/clamps. The pole stabilizing device 20 is reusable, but the straps 30 may be discarded after one use and replaced with new straps. The bolts/clamps that tighten the straps are reusable.

Assembly in the Field:

When a damaged pole 10 has been identified, the installer loosely assembles the pole stabilizing device 20 around the damaged pole 10. The left vertical bracket 24 is assembled to the left side of the main vertical plate 22 using the nuts and bolts 44 extending through respective aligned openings 38, 42. Similarly, the right vertical bracket 26 is assembled to the right side of the main vertical plate 22 using the nuts and bolts 44 extending through respective aligned openings 38, 42. Each strap 30 is fed through a respective strap-receiving slot 40 on the left side of the main vertical plate 22, through the respective aligned strap-receiving slot 46 in the left bracket 24, is received in the respective aligned indentation 58 on the second leg 50 of the left brackets 24 and in the respective aligned indentation 58 on the second leg of the right bracket 26, extends through the respective aligned strap-receiving slot 46 in the right bracket 26, through the respective aligned strap-receiving slot 40 on the right side of the main vertical plate 22, and is secured back to itself using a clamp/bolt arrangement.

Once the device 20 is loosely assembled around the pole 10, the installer identifies the most advantageous location for the bottoms of the "Z-shaped" feet 28 and secures them to the base 12 via the anchor screws 70. The main plate 22 is adjustably secured to the top leg 60 of one of the "Z-shaped" feet 28 with the nut and bolt arrangement 36 via the slotted opening 34 on the main plate 22 and the round opening 66 on the "Z-shaped" foot 28.

The left and right brackets 24, 26 also are adjustably secured to the top legs 60 of their respective "Z-shaped" feet 28 with the nut and bolt arrangement 36 via the slotted opening 54 on the respective bracket 24, 26 and the round opening 66 on the respective "Z-shaped" foot 28. The bolts securing the left and right vertical brackets 24, 26 to the main vertical plate 22 are tightened, with the second legs 50 of the left and right brackets 24, 26 snugly abutting the main vertical shaft of the pole 10 and with the main vertical plate 22 snugly abutting the main vertical shaft of the pole 10. The straps 30 also are tightened, to securely clamp the pole stabilizing device 20 onto the pole 10. This provides a secure, rigid brace between the lower portion of the pole 10 and the foundation or base 12.

Since the main plate 22 and left and right brackets 24, 26 are individually positioned, and the bolts 44 and the straps 30 are separately tightened at each respective elevation, this pole stabilizing device 20 can be used on a wide variety of pole shapes, and on straight or tapered poles, including round poles, square poles, hexagonal poles, other multi-sided poles, and poles of many different diameters.

Figure 10:
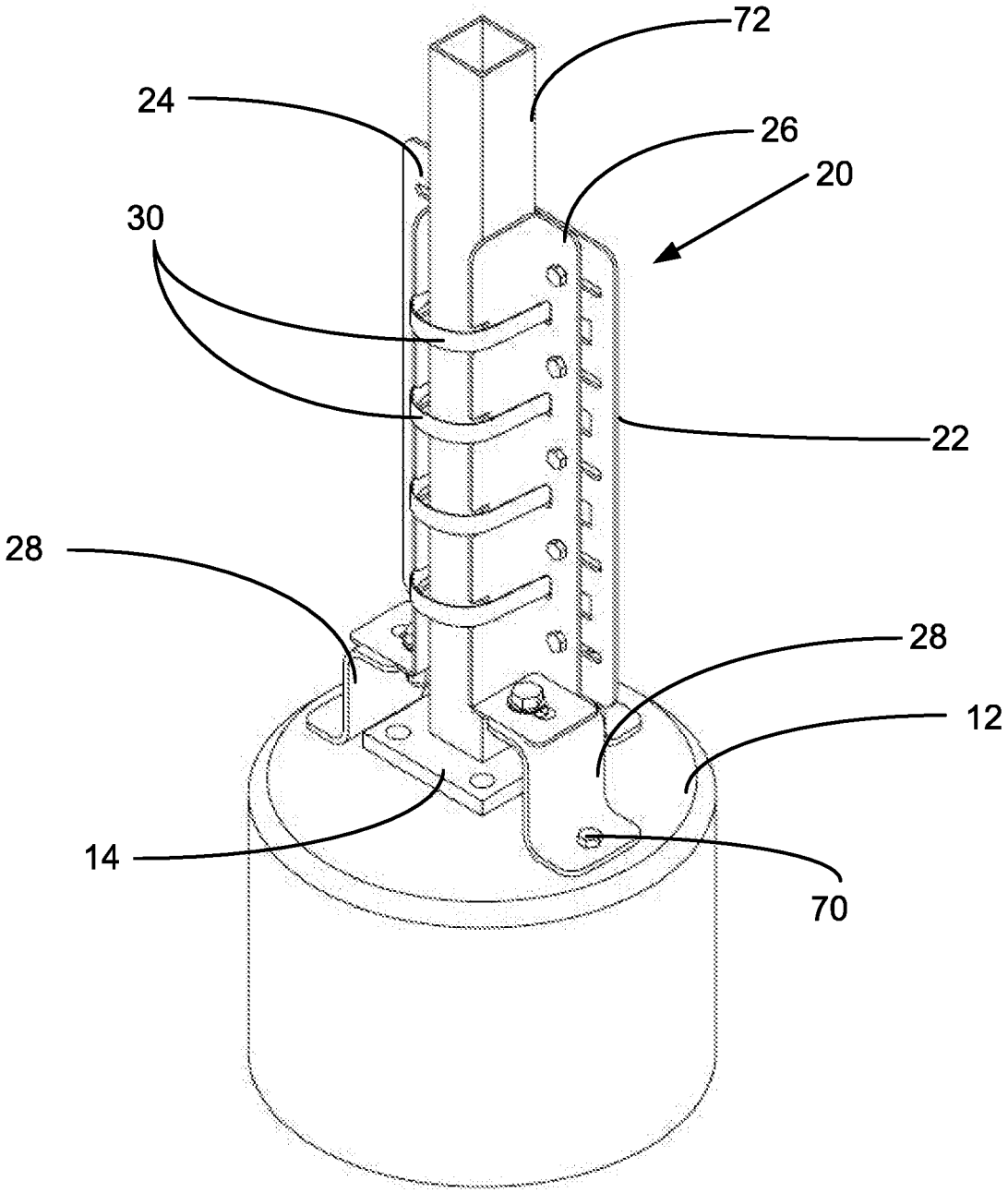
FIG. 10 is a broken-away, perspective view, similar to that of FIG. 2, but showing a square pole instead of a round pole with the stabilizing device of FIG. 2 assembled onto the square pole.

FIG. 10 shows the pole stabilizing device 20 secured to a square cross-section pole 72.

It will be obvious to those skilled in the art that modifications may be made to the embodiment described above without departing from the scope of the present invention as claimed.

What is claimed is:

1. A pole stabilizing device for stabilizing a pole that is mounted on a foundation, comprising:

a main vertical plate having a horizontal plate bottom foot and defining left and right columns of openings, including a plurality of first bolt-receiving openings and a plurality of taller, first strap-receiving openings;

left and right vertical brackets, each having an "L-shaped" cross-section, including a vertical first leg, a vertical second leg and a horizontal bracket bottom foot, said vertical first leg defining a plurality of second bolt-receiving openings and a plurality of taller, second strap-receiving slots; said second bolt-receiving openings being aligned with said first bolt receiving openings in said main plate, and said second strap-receiving slots being aligned with respective first strap receiving slots in said main plate; said second leg having an outer edge defining a plurality of indentations aligned with said second strap-receiving slots;

a plurality of straps and a plurality of bolts, wherein, when said plate bottom foot and said left and right bracket bottom feet are secured to a foundation, said bolts extend through respective aligned second bolt openings in said respective vertical brackets and through respective first bolt openings in said main vertical plate to secure said left and right vertical brackets to said main vertical plate, and said straps extend through respective second strap receiving slots in said left and right brackets, through said first strap-receiving slots in said main plate and are received in said strap-receiving indentations to secure the pole stabilizing device to the pole.

2. A pole stabilizing device for stabilizing a pole that is mounted on a foundation as recited in claim 1, wherein said first bolt-receiving openings are slots extending in a horizontal direction.

3. A pole stabilizing device for stabilizing a pole that is mounted on a foundation as recited in claim 2, wherein said second bolt-receiving openings are circular.

4. A pole stabilizing device for stabilizing a pole that is mounted on a foundation as recited in claim 1, and further comprising a plurality of "Z-shaped" feet, each having an inwardly-directed top leg for securing to a respective bottom foot on one of said main vertical plate and said left and right vertical brackets and an outwardly-directed bottom leg for securing to the foundation.

5. A pole stabilizing device for stabilizing a pole that is mounted on a foundation as recited in claim 4, wherein said "Z-shaped" feet are mounted to the foundation, each of said main vertical plate and said left and right vertical brackets is mounted to one of said "Z-shaped" feet; and said main vertical plate, left and right vertical brackets, and straps surround and press against the pole.

* * * * *